United States Patent [19]

Cornell

[11] 3,935,960

[45] Feb. 3, 1976

[54] TAMPER INDICATOR TAPE

[75] Inventor: Lew W. Cornell, Mound, Minn.

[73] Assignee: Minnesota Mining and Manufacturing Company, St. Paul, Minn.

[22] Filed: Jan. 30, 1975

[21] Appl. No.: 545,374

Related U.S. Application Data

[62] Division of Ser. No. 397,797, Sept. 17, 1973, Pat. No. 3,896,965.

[52] U.S. Cl. ..... 220/260; 220/265; 220/359; 40/2.2

[51] Int. Cl.[2] ..... B65D 41/02; B65D 41/00

[58] Field of Search ..... 220/260, 359, 265; 40/2.2

[56] References Cited

UNITED STATES PATENTS

| | | | |
|---|---|---|---|
| 3,292,828 | 12/1966 | Stuart | 220/359 X |
| 3,516,852 | 6/1970 | Janssen et al. | 220/260 X |

*Primary Examiner*—George T. Hall

*Attorney, Agent, or Firm*—Alexander, Sell, Steldt & Delahunt

[57] ABSTRACT

An easy opening, hermetically sealed container with a preformed aperture is covered by a tape closure having on its outer surface an indicator layer which changes color when flexed, thereby indicating whether the closure has been handled or tampered with.

3 Claims, 4 Drawing Figures

TAMPER INDICATOR TAPE

CROSS REFERENCE TO RELATED APPLICATION

This application is a division of copending patent application Ser. No. 397,797, filed Sept. 17, 1973, now U.S. Pat. No. 3,896,965.

BACKGROUND OF THE INVENTION

This invention relates to an improved tape container closure.

In recent years containers have been hermetically sealed with easily opened tape closures which are affixed over a hole, or aperture, in the container wall by heat sealing or a pressure-sensitive adhesive; see U.S. Pat. No. 3,389,827. The closure has one free end which is easily gripped by fingers and pulled so as to separate it from the can. The contents, e.g. fruit juice, oil, salt, etc. can then be removed via the exposed aperture.

This closure provides a good, effective seal and has gained wide acceptance for sealing open cans. It is possible, however, to carefully break the seal, remove or adulterate the contents of the can, and then replace the tape closure, leaving no readily visible traces of the tampering.

A tape closure having a tamper indicator system which changes color when an attempt has been made to remove it with the aid of an organic solvents, is disclosed in U.S. Pat. No. 3,680,236. This indicator incorporates a layer containing a dye which dissolves and stains the backing when it is contacted with an organic solvent such as kerosene or toluene. Such an indicator will not function where the tape closure is removed by purely mechanical means.

BRIEF SUMMARY OF THE INVENTION

This invention comprises a modification of tape closures such as those described in aforementioned U.S. Pat. No. 3,389,827, the disclosure of which is incorporated herein by reference.

The modified tape closure of this invention has on at least a portion of its exposed face an indicator layer comprising a strong, flexible binder matrix throughout which are dispersed a solid color-forming material and capsules filled with a liquid which includes a dye precursor reactable with the color-forming material. If the dye precursor is not itself a liquid, it can be dissolved in a suitable solvent. When the closure is flexed by force applied to the free end of the closure, the capsules rupture and the color-forming material reacts with the dye precursor to form a colored dye, indicating the can closure has been tampered with. At least a portion of the indicator layer lies in the area intermediate the free end of the closure and the near edge of the aperture so that an attempt to remove the closure causes a color change in the indicator strip before any portion of the aperture is exposed.

The indicator layer can either be formed as a strip of tape which is attached to the back of a conventional tape closure or as a sheet of material from which complete can closures are cut. Either embodiment allows the production of a convolutely wound roll of sheet material which can be subsequently cut into tape closures of any desired size or configuration.

An indicator strip can be formed from a polymeric film backing material, e.g., biaxially oriented polyethylene terephthalate film, normally having a thickness of about 1 to 3 mils. Other suitable backings include films of cellulose acetate, aluminum vapor-coated polyester, cellophane, polyvinyl chloride, metal foils, polyurethane-saturated flat stock paper, etc. The backing should be chosen so it is adhesive receptive but is not degraded or otherwise adversely affected by the binder or its solvents. A presently preferred backing material is biaxially oriented polyethylene terephthalate film.

The indicator strip is secured to the tape closure by an adhesive, such as an acrylate, rubber-resin or other adhesive commonly used in the pressure-sensitive tape art. Hot melt or solvent activated adhesives could be used but are more difficult to apply and pressure-sensitive adhesives are preferred because of their ease of application. The adhesive should bond the backing to the tap closure so that the indicator strip will not delaminate from the tape closure when the tape closure is flexed and any attempt to pull the indicator strip off the tape closure will activate the indicator strip.

On the exposed side of the backing, opposite the adhesive, is an indicator coating comprising a combination of binder resin, reactant materials, and perhaps fillers. If allowed to contact each other the reactant materials, which comprise (1) a liquid consisting essentially of a dye precursor and (2) a color-forming substance, will react to form a dye. The liquid dye precursor, however, is encapsulated and separated from the coreactant to prevent premature color development. Normally the color-forming substance is a finely dispersed solid material; however, it could also be an encapsulated liquid. The binder resin should have a high enough tensile or Young's modulus that the force exerted to flex the closure tab upon opening will rupture the enclosed capsules. Suitable binder resins can be selected from the acrylics, polystyrene, polyvinylchloride, polyvinylbutyral, polycarbonate, etc.

In order to provide a system which will insure rupture of the capsules, it has been determined empirically that the binder should have a minimum Young's modulus, measured at 2% elongation, of 125,000 psi. Binders having a significantly lower Young's modulus will deform when the tape closure is flexed, so that the capsules will not rupture to release the liquid, and hence satisfactory color change does not take place.

The binder resin is preferably pale or water white, but in any case, it should not have a distinct color which would block or otherwise obscure the color of the dye formed during flexing of the closures. The resin chosen should also be compatible with the backing on which it is coated.

When the closure is flexed, the capsules rupture, the encapsulated liquid is released, and the co-reactants form a dye. One example of a suitable color forming combination is nickel rosinate and dithiooxamid derivatives, both of which are initially colorless but which react to form a deep purple dye. A further example is triphenyl methane leuco and acidic clays, which react to form a blue to purple color. Also useful is leuco methyl violet, which reacts to form brown. The leuco form of "Malachite Green" reacts with tannic acid to form a deep green.

Suitable liquid-containing microcapsules may be produced by dispersing the liquid dye precursor as finely divided droplets in an aqueous, water-soluble urea-formaldehyde precondensate solution, and acid-catalyzing the precondensate to form urea-formaldehyde polymer, around the dispersed droplets. A process for making encapsulated liquid materials can be found in U.S. Pat. Nos. 3,516,846 and 3,516,941, the disclosures of which are incorporated herein by reference.

The capsules containing the liquid reactant will generally represent about ⅓ to ½ by volume of the indicator layer. Above one-half by volume the capsules represent such a large portion of the indicator layer that it simply falls apart when the closure is flexed. As the percentage of capsules in the indicator layer is decreased substantially below about ⅓ by volume, the intensity of the color formed by flexing the closures decreases, and removing the tape closure at shallow angles, e.g., about 45° to 60°, does not produce a deep color change. Thus, these closures would be subject to careful tampering and are not preferred for containers with food items. Such closures could be useful in less stringent applications, such as sealing oil containers, etc.

If desired, a pigment, such as titanium dioxide, may be added to the binder to provide a contrasting background and enhance the visibility of color changes, increasing the tamper indicator's sensitivity.

The indicator coating will generally be about 0.5 to 5 mils in thickness, preferably about 1 to 3 mils. Coating thicknesses below about 1 mil develop less color than heavier coatings when the closure is pulled off at a shallow angle. Coatings of 3 to 5 mils and greater are more difficult to apply and have a tendency to crack when sharply flexed, thereby reducing the intensity of the color change.

The indicator layer may be either a continuous film or in the form of a pattern, such as squares or dots. The indicator can also be applied in the shape of a word such as "opened", which would become highly colored when the closure is flexed and thereby emphasize that the seal had been tampered with.

BRIEF DESCRIPTION OF THE DRAWINGS

A further understanding of the invention may be had by referring to the accompanying drawing in which like numbers refer to like parts in the several views and in which.

DETAILED DESCRIPTION OF THE PREFERRED EMBODIMENTS

Figure 1:
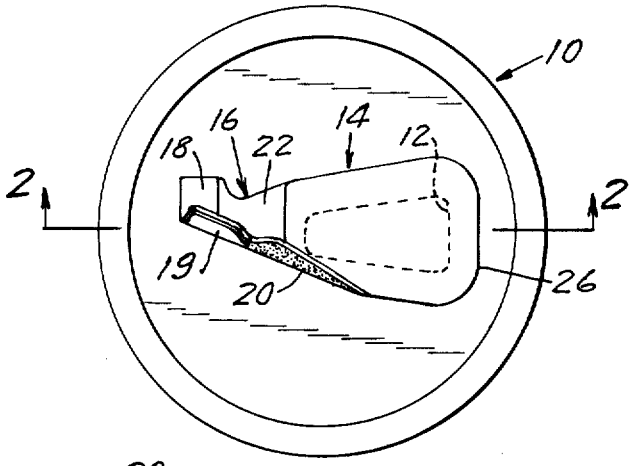
FIG. 1 is a top plan view of a can lid having an aperture covered by a tape closure of this invention.
Figure 2:
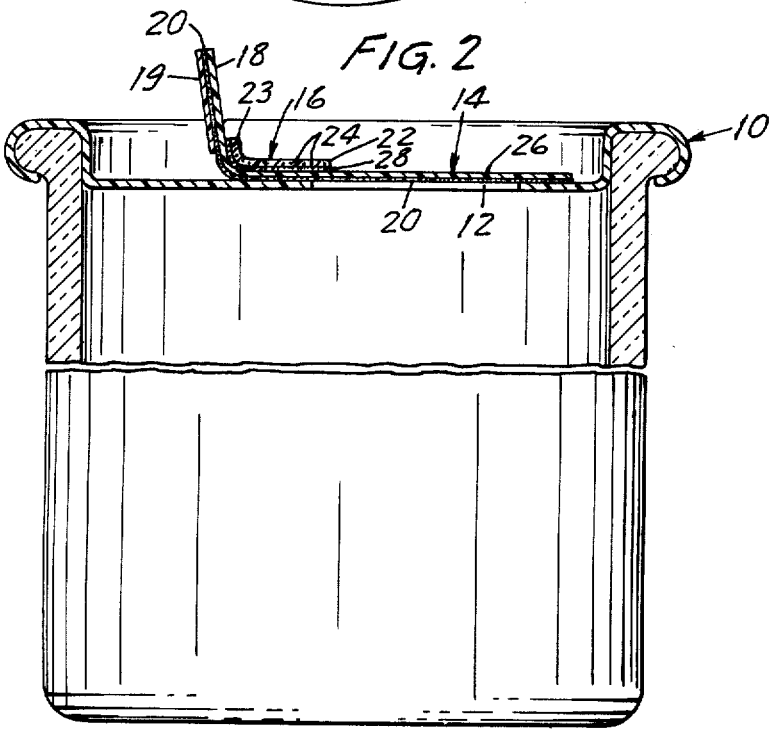
FIG. 2 is a cross-sectional view of FIG. 1 taken along the section line 2—2, looking in the direction of the arrows.

Referring to the drawings, and initially to FIGS. 1 and 2, can top 10 is provided with aperture 12, tape closure 14 overlying can top 10 and sealing aperture 12. Closure 14 comprises film backing sheet 26, adhesive 20 being applied over the lower surface thereof and serving to bond closure 14, to can top 10. At the distal portion of closure 14, adhesive 20 is covered by a small piece of film 19, thereby forming grip tap 18 to aid in removal.

On the upper surface of film backing layer 26 is a layer of binder material 23, throughout which are dispersed capsules 24 filled with liquid dye precursor and finely divided particles of material capable of reacting with the dye precursor to form a dye.

When tab 18 is gripped and pulled upward to remove closure 14 from top 10, capsules 24 will rupture, thereby releasing their liquid contents, which will react with the solid coreactant to form a dye and thus show that closure 14 has been tampered with. Even if closure 14 is thereafter reapplied to can top 10, the evidence of the prior opening of the seal remains.

Figure 3:
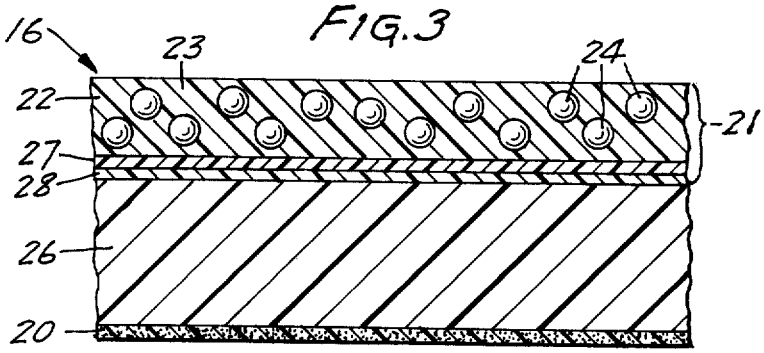
FIG. 3 is an enlarged cross-sectional view of another type of tape closure made in accordance with the invention.

FIG. 3 shows another embodiment of this invention, where the indicator layer is incorporated as part of a separate tape construction 21. Layer 22, comprising liquid-containing capsules 24 in binder 23, is coated on and bonded to film substrate 27 to form a laminate. The resulting laminate is then adhered to the top surface of film 26 by adhesive layer 28.

Figure 4:
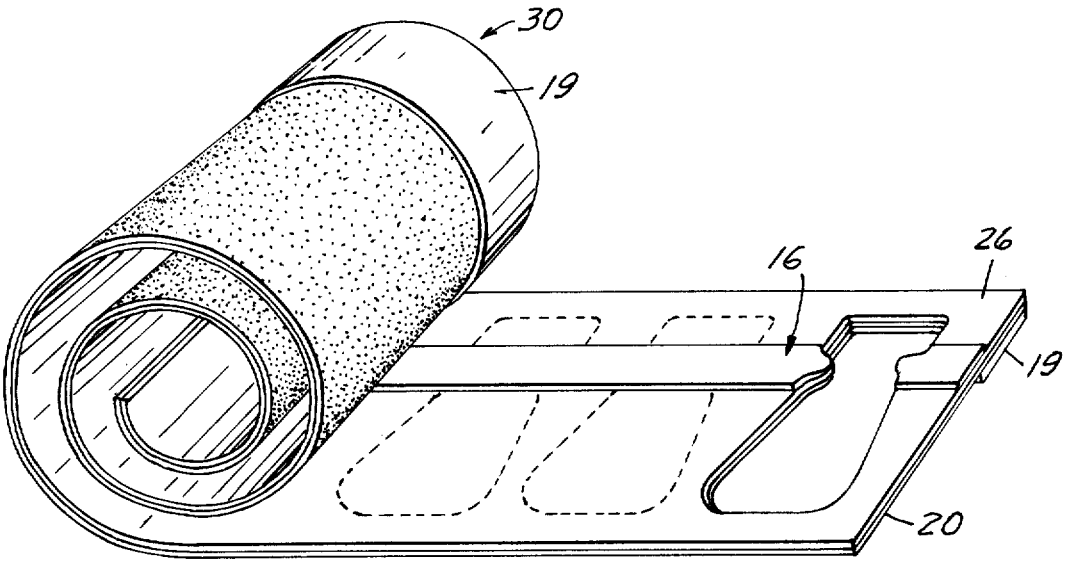
FIG. 4 is a perspective view of a roll of tape suitable for making can closures of this invention.

A roll 30 of material suitable for forming the can closure of this invention is shown in FIG. 4. A film 26 suitable for forming can closures has a strip of indicator material 16 longitudinally adhered to the film. Can closures having the desired configuration can be die-cut from roll 30 and the resulting closure mounted on a can top as shown in FIGS. 1 or 2.

The invention is further described with reference to the following examples. All parts are by weight unless otherwise noted.

Example 1

| A mixture comprising: | |
|---|---|
| 9.0 parts | of the condensed formaldehyde capsules containing derivatives of dithiooxamide described in U.S. Pat. No. 3,516,941, Example 18, having a diameter of about 15 microns; |
| 9.0 parts | nickel rosinate |
| 13.2 parts | isophthalic-terephthalic acid/ethylene glycol copolyester resin having a ring and ball softening point of 155°C. ("Vitel" PE-200, available from Goodyear Chemical Co.), diluted to 40% solids with a 1:2 toluol-methyl ethyl ketone solvent; |
| 13.5 parts | methyl ethyl ketone |

was gently blended, to prevent capsule rupture, to a uniform consistency with an air driven propeller mixer and knife coated at a wet thickness of 3 mils on 1 mil biaxially oriented polyethylene terephthalate film. The coating was dried at 65°C. for 20 minutes to form a dry indicator layer between 1 and 2 mils (0.025 – 0.05 mm.) thick.

A pressure sensitive adhesive was made by milling 100 parts "Kraton" 1101 block copolymer (an ABA block copolymer where A is 15,000 molecular weight polystyrene and B is 30,000 molecular weight polybutadiene) and 85 parts "Hercules" S1010, a $\beta$-terpene. The blend was diluted with toluene to 40% solids and knife coated on the film surface opposite the dry indicator layer. The film was dried at 65°C. for 20 minutes to evaporate the toluene, leaving 15 grains of adhesive per 24 square inches. The coated film was adhesively bonded to the upper surface of a can closure similar to that disclosed in Example II of U.S. Pat. No. 3,389,827. The indicator layer turned deep purple when the closure was removed from a can top even at shallow angles.

EXAMPLE 2

A closure like that of Example 1 was made using as the coating mixture 18 parts of the capsules described in Example 1, 9 parts nickel rosinate, 13.2 parts 40% solids "Vitel" PE200 in a 1:2 toluene:methyl ethyl ketone solvent, and 21.6 parts of methyl ethyl ketone.

The resulting indicator closures give a slightly deeper purple color than those of Example 1 when the closures were removed from can tops at shallow angles of about 45°.

EXAMPLE 3

A closure like that of Example 1 was made using a coating comprising

| | |
|---|---|
| 18 parts | capsules of Example 1 |
| 18 parts | nickel rosinate |
| 15 parts | 35% solids "Vitel" PE-200 in cyclohexanone; and |
| 28.8 parts | cyclohexanone |

The resulting indicator closures changed color when removed from can lids. When the closures were removed at 45°, the color was light purple, lighter than in previous examples, although still acceptable.

EXAMPLE 4

A family of blends of "Vitel" PE200 and "Vitel" PE207 (the latter being an isophthalic-terephthalic acid/ethylene glycol copolymer having a ring and ball softening point of 127°C.), each weighing 200 grams, were prepared by milling on a two roll rubber mill at about 310°F. for about 10 minutes and allowed to cool. The blends were hot pressed at 375°F. between two sheets of release paper, using a force of 10,000 pounds, to form sheets about 50 to 65 mils thick.

Test pieces, conforming to ASTM Test Standard D1708–66, were stamped from the sheets using a standard die. The test pieces were dumbbell-shaped, approximately 1.5 inches long × 0.625 inch wide in their greatest dimension, with a reduced center section 0.876 inch long and 0.187 inch wide. Samples *h* – *k* were brittle and heated with a warm air gun until the polymer started to soften to facilitate stamping. The die-cut pieces were stress-relieved in a warm air oven at 150°F., for a sufficient time to insure that no residual stress remained from stamping and then conditioned for 24 hours at 72°F. and 50% relative humidity.

The samples were mounted in an "Instron" tensile machine and the jaws separated at a rate of 1 inch/minute until break or a 10% elongation was reached, whichever occurred first. The average Young's moduli of 3 tensile specimens of each blend are given in Table I.

Blends of resins, corresponding to the samples, were made and used in place of the "Vitel" PE200 as a binder resin in making tape closures which were otherwise identical to that of Example I. The resulting closures were mounted on can lids and removed at three different angles. First, the closures were pulled away at a shallow angle, where the angle between the adhesive-coated surface of the tape closure and the can lid was about 45°–60°. Second, they were pulled vertically away from the can top at a removal angle of about 90°. Third, the closures were doubled back upon theselves and pulled away at a removal angle of about 180°.

TABLE I

| Sample | %"Vitel" PE200 by Weight | %"Vitel" PE207 by Weight | Young's Mod. at 2% Elongation |
|---|---|---|---|
| a | 0 | 100 | 810 |
| b | 10 | 90 | 3,360 |
| c | 20 | 80 | 12,421 |

TABLE I-continued

| Sample | %"Vitel" PE200 by Weight | %"Vitel" PE207 by Weight | Young's Mod. at 2% Elongation |
|---|---|---|---|
| d | 30 | 70 | 23,966 |
| e | 40 | 60 | 48,358 |
| f | 50 | 50 | 71,906 |
| g | 60 | 40 | 94,302 |
| h | 70 | 30 | 139,168 |
| i | 80 | 20 | 156,667 |
| j | 90 | 10 | 194,770 |
| k | 100 | 0 | 174,496 |

Closures made with binder compositions *h* – *k* produced a deep purple color change, even when removed at shallow angles. On the other hand, closures made with binder compositions *a* – *g* did not give an acceptable color change when removed even at angles of 90°–180°.

Further testing of blends in the composition range lying between samples *g* and *h* established that a ratio of 2:1 "Vitel" PE200:PE207 gave a binder composition which gave a light color change when the tape closure was removed at a shallow angle and deeper color at 90°–180° removal angles. This blend corresponds to a binder having a Young's modulus at 2% of about 125,000 psi. Ratios of 3:1 gave a good color change even when removed at shallow angles and have a Young's modulus at 2% of about 150,000 psi.

EXAMPLE 5

Example 1 was repeated, employing the same amounts of capsules and nickel rosinate but varying the binder system.

Binders used were:

a. 31.5 parts of a 16.8 weight percent solids VYNS (polyvinylchloride available from Union Carbide) resin in methyl ethyl ketone, 6.0 parts MEK, having a Young's modulus of 280,000 psi;

b. 35.1 parts of 15 weight percent solids polyvinyl butyral in toluol (available as "Butvar" B–76 from Shawinigan Chemicals), 21 parts toluol and 6 parts methyl ethyl ketone, having a Young's modulus of 227,000 psi; and c. 23.4 parts of 22.5 weight percent solids polycarbonate in dichloromethane (available as "Rowlux" from Rowland Products), and 18 parts dichloromethane, having a Young's modulus of 207,000 psi.

Tape closures made with binders *a* and *c* produced a faint lavender when pulled from can tops at a shallow angle, the depth and amount of color increasing when the closure is pulled off at 90° or more.

Tape closures made using binder *b* produced a light purple color when removed at 90° and deep color when pulled back upon itself at 180°.

What is claimed is:

1. An adhesive tape having particular utility in preparing a sealed container comprising in combination a sheet backing material to one face of which is firmly adherently bonded a smooth, uniform coating of normally tacky and pressure-sensitive adhesive and to the other face of which is firmly adhesively bonded an indicator layer comprising a strong flexible binder matrix having a Young's modulus at 2% elongation of at least about 125,000 pounds per square inch, said binder containing dispersed throughout, a solid, color-forming substance and capsules containing a liquid dye precursor reactable with said color-forming substance.

2. The tape of claim 1 where said color-forming solid reactant is nickel rosinate and said liquid color former is a dithiooxamide derivative.

3. The tape of claim 1, where said binder contains titanium dioxide dispersed in the indicator layer.

* * * * *